US007513400B2

(12) United States Patent
Gouldson

(10) Patent No.: US 7,513,400 B2
(45) Date of Patent: Apr. 7, 2009

(54) SPRING TOP LOWER NECK HANGER SIZING

(75) Inventor: Stanley F. Gouldson, Northport, NY (US)

(73) Assignee: Spotless Plastics Pty, Ltd. (AU)

( * ) Notice: Subject to any disclaimer, the term of this patent is extended or adjusted under 35 U.S.C. 154(b) by 0 days.

(21) Appl. No.: 11/679,390

(22) Filed: Feb. 27, 2007

(65) Prior Publication Data

US 2007/0199963 A1 Aug. 30, 2007

Related U.S. Application Data

(60) Provisional application No. 60/777,609, filed on Feb. 28, 2006.

(51) Int. Cl.
*A41D 27/22* (2006.01)

(52) U.S. Cl. ..... 223/85; 40/322

(58) Field of Classification Search ..... 223/85, 223/88, 92, 95, DIG. 4; 40/322; D6/328
See application file for complete search history.

(56) References Cited

U.S. PATENT DOCUMENTS 1,888,137 A * 11/1932 Molner ..... 223/93
2,586,913 A * 2/1952 Burns ..... 223/88
4,123,864 A * 11/1978 Batts et al. ..... 40/322
4,322,902 A 4/1982 Lenthall
4,881,836 A * 11/1989 Blanchard ..... 40/322
5,377,884 A * 1/1995 Zuckerman ..... 223/85
5,398,854 A * 3/1995 Blanchard ..... 223/85
5,503,310 A * 4/1996 Zuckerman et al. ..... 223/85
5,503,311 A * 4/1996 Chen ..... 223/85
5,577,644 A * 11/1996 Chen ..... 223/85
5,586,697 A * 12/1996 Johansson ..... 223/85
5,687,887 A * 11/1997 Bond et al. ..... 223/85
6,170,721 B1 * 1/2001 Chen ..... 223/85
7,240,813 B1 7/2007 Goldman
D552,361 S 10/2007 Goldman
7,287,674 B1 * 10/2007 Sutton et al. ..... 223/85
7,303,101 B2 12/2007 Goldman (Continued)

FOREIGN PATENT DOCUMENTS

AU 459115 3/1974

(Continued)

*Primary Examiner*—Gary L. Welch
*Assistant Examiner*—Nathan E Durham
(74) *Attorney, Agent, or Firm*—Scully, Scott, Murphy & Presser, P.C.

(57) ABSTRACT

A combination hanger and indicator, or either of them separately, the hanger with a body and a post extending upward from the body, the intersection of the post and the body defining a lower neck region of the hanger, the post having a flange extending outward from the post at a position removed from the body of the hanger. An indicator includes a pair of opposing side walls connected by a pair of opposing end walls, with an opening in the top of the indicator, the opening defined at least in part by a displaceable resilient tab, preferably two positioned on opposite sides of the indicator, attached to one of the side walls or end walls, wherein displacement of the tab enlarges the opening to admit the flange. At least some portion of the post between the flange and the body is smaller than the flange to reduce the displacement of the tab.

18 Claims, 3 Drawing Sheets

U.S. PATENT DOCUMENTS

| | | | | |
|---|---|---|---|---|
| 2006/0006204 | A1* | 1/2006 | Mainetti | 223/85 |
| 2006/0213938 | A1* | 9/2006 | Gouldson | 223/85 |
| 2007/0084889 | A1* | 4/2007 | Fleming | 223/85 |
| 2007/0145084 | A1* | 6/2007 | Goldman | 223/85 |

FOREIGN PATENT DOCUMENTS

| | | | |
|---|---|---|---|
| EP | 1702540 | A1 | 9/2006 |
| GB | 2318726 | A | 5/1998 |

* cited by examiner

SPRING TOP LOWER NECK HANGER SIZING

CROSS REFERENCE OF RELATED APPLICATIONS

Under 35 U.S.C. §119(e), this application claims priority of U.S. Provisional Patent Application Ser. No. 60/777,609 filed Feb. 28, 2006, entitled Spring Top Lower Neck Hanger Sizing, the disclosure of which is hereby incorporated by reference in its entirety for all purposes.

FIELD OF INVENTION

The present invention relates to the field of garment hangers, and more particularly to a garment hanger adapted to receive and retain a sizing indicator at the junction of the hook and body.

DESCRIPTION OF RELATED ART

In the area of retail garment sales, so-called Garment-On-Hanger (GOH) programs have become preferred by retailers. In a GOH program, garments are delivered to retail merchants already suspended from hangers, whereupon arrival at the retail location they may immediately be placed on display for sale. Formerly, retailers accomplished the task of suspending garments from hangers with labor provided at their own expense.

In particular, retailers have specified particular hangers or hanger characteristics among their several suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). One particular standardized hanger feature is extremely popular across several hanger models, namely a turnable wire hook mated to a plastic hanger.

Additionally, and interrelated to the promulgation of GOH programs, retailers and their customers desire to have the hanger itself display some indicia regarding the item carried upon it. Categories of indicia could include manufacturer, material and price, but most notably for garments, their size. Various means for accomplishing this have been developed, including those disclosed in U.S. Pat. No. 5,884,422 to Marshal, et al., and U.S. Pat. No. 6,019,260 to Gouldson, both of which are commonly assigned with the instant application, among others. Popular among these are the type disclosed in the latter patent just mentioned, i.e., those that secure to the hanger adjacent the intersection of the hook and the hanger body to one side of the hook, appropriately called side-sizer tabs, or simply side-sizers; lower neck sizers or indicatiors.

However, these hangers are specifically designed to perform their functions, and do not conform to industry standard for form, size and appearance. Moreover, they have a distinctive appearance, which may not be desirable. Therefore, a garment hanger and a lower neck indicator secured thereto that generally conforms to applicable industry standards would be desirable.

BRIEF SUMMARY OF THE INVENTION

Therefore, provided according to the present invention is a combination hanger and indicator, the combination including a hanger with a body and a post extending upward from the body, the intersection of the post and the body defining a lower neck region of the hanger, the post having a flange extending outward from the post at a position removed from the body of the hanger. An indicator includes a pair of opposing side walls connected by a pair of opposing end walls, with an opening in the top of the indicator, the opening defined at least in part by a displaceable resilient tab, preferably two positioned on opposite sides of the indicator, attached to one of the side walls or end walls, wherein displacement of the tab enlarges the opening to admit the flange. At least some portion of the post between the flange and the body is smaller than the flange to reduce the displacement of the tab.

The hanger may further include a recess in the flange, sized and positioned to receive a free end of the resilient tab and thereby limit the vertical and lateral movement of the indicator. The recess can be a step-wise recess, a concave recess, a convex filet, or an chamfer.

The side walls of the indicator may be generally trapezoidal in profile. The resilient tab is preferably attached to the indicator at an end wall thereof, more preferably at the end wall displaced from the top of the end wall, separated from the indicator by at least two slots.

The hanger may include a niche in the post, including a first generally horizontal surface, sized and positioned to receive projection extending inwardly from a wall of the indictor, the projection having a second generally horizontal surface.

The present invention further comprises either of the hanger or indicator described apart from the other.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE INVENTION

Figure 1:
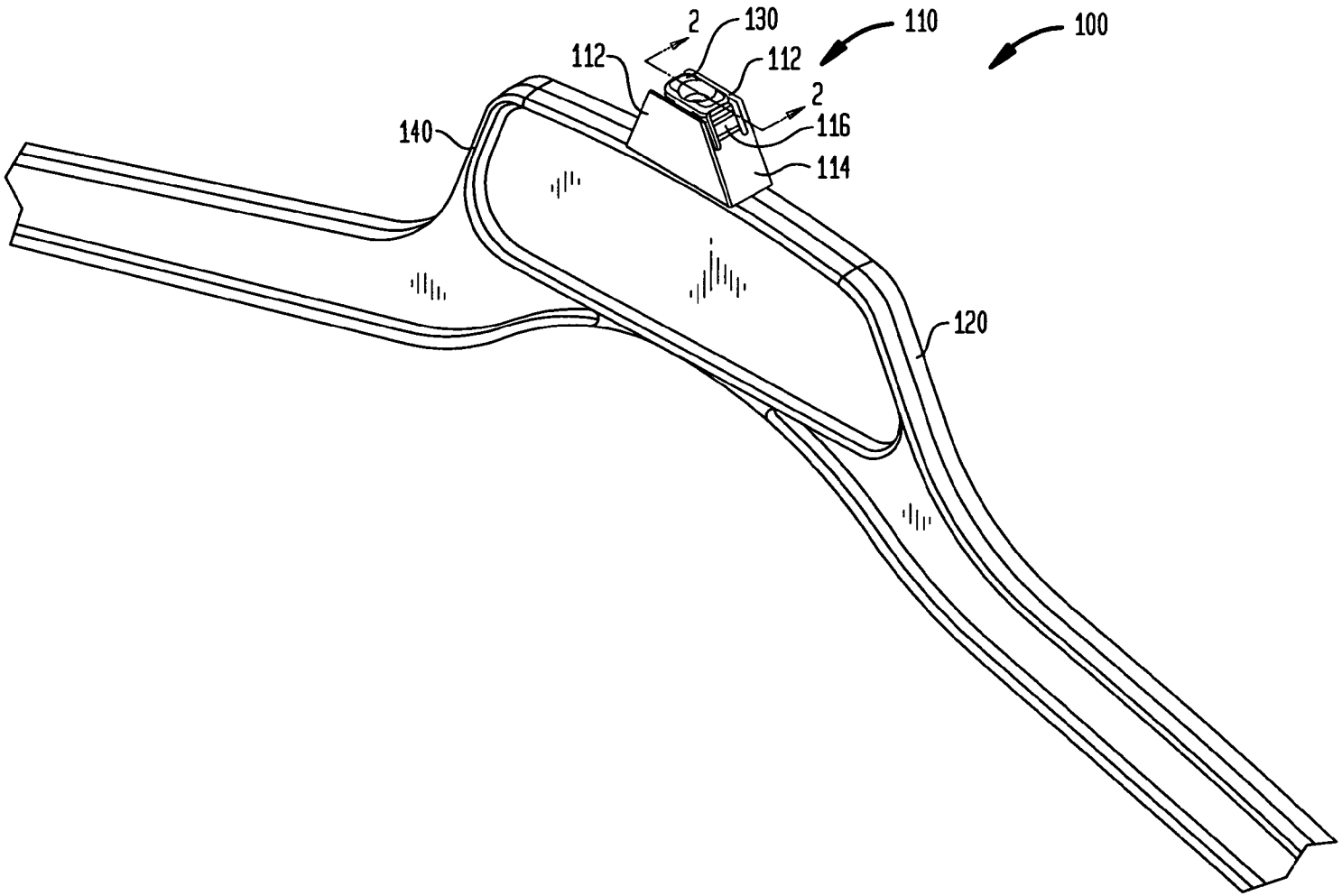
FIG. 1 illustrates a perspective view of a hanger and spring-top lower neck sizer assembly according to a first embodiment of the present invention.

Referring now to FIG. 1, illustrated in perspective view is a portion of a hanger and spring-top lower neck sizer assembly, generally 100, according to a first embodiment of the present invention. The assembly 100 includes the spring-top indicator 110 and hanger 120. Hanger 120 preferably conforms to established industry standards of form, for example, as promulgated by VICS. In this embodiment, hanger 120 has a lower neck portion 130 for receiving a turnable metal hook (not shown) extending from a body 140 of the hanger 120. Spring-top indicator 110 generally surrounds lower neck portion 130. In the exemplary embodiment, the spring-top indicator 110 has generally trapezoidal front and rear sides 112, which are connected by ends 114. Resilient retaining tab 116 on at least one side 112 or end 114 of the spring-top indicator 110, but preferably at both ends 114, engage the lower neck portion 130 of the hanger 120 to secure it thereto.

Figure 2:
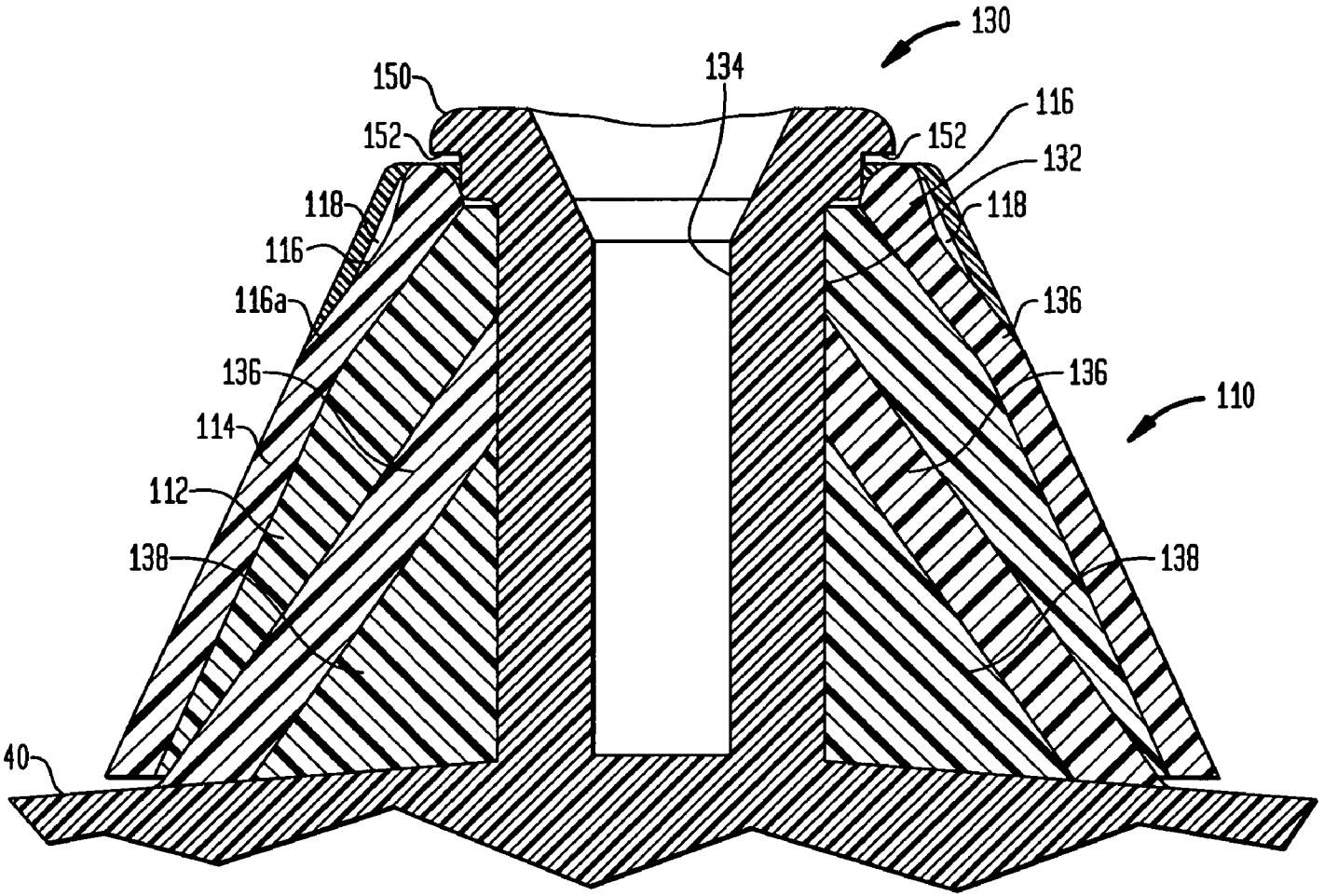
FIG. 2 illustrates a cross sectional view through the lower neck portion and spring-top indicator, taken along line 2-2 of FIG. 1.

Referring now to FIG. 2, illustrated is a cross sectional view through the lower neck portion 130 and spring-top indicator 110, taken along line 2-2 of FIG. 1. Lower neck portion 130 may include a post 132 having a bore 134 for receiving a turnable metal hook (not shown). The post 132 is supported by legs 136 on either side, and webs 138 in the space bounded by post 134, legs 136, and the hanger body 140. Near the top of the lower neck portion 130, a flange 150 extends outward from the post 132. The flange 150 includes a recess 152 sized and positioned to engage the retaining tab 116 of the spring top indicator 110.

The flange 150, particularly recess 152, cooperates with retaining tab 116 to exert simultaneous outward and downward bias on the indicator 110. Recess 152 is illustrated as a step-wise recess, but may be embodied as a concave recess, a convex filet, or a chamfer. Moreover, the flange 150 and recess 152 may permit some clearance from the indicator 110, not engaging it at all times, yet inhibiting lateral and/or upward motion of the indicator 110 once engaged with hanger 120. Further, the recess 152 allows for the post 134 to be thinner, thereby conserving material. However, the flange 150 may be provided without a recess where the post 134 and the indicator 110 are sized such that the recess is not necessary to maintain lateral stability of the indicator 110.

Figure 3:
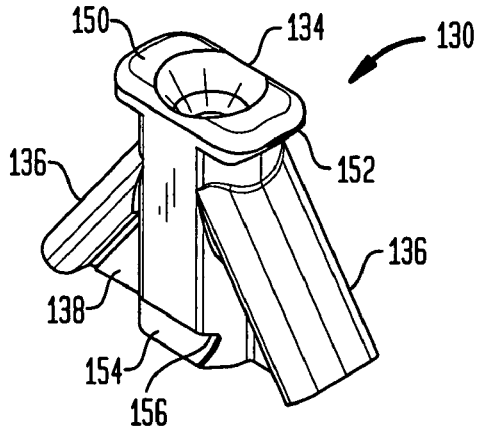
FIG. 3 illustrates a perspective view of the lower neck portion of the hanger of FIG. 1.

Additionally, and as seen with reference to FIG. 3, a perspective view of the lower neck portion 130 only, the flange 150 in the illustrated embodiment extends only laterally from the post 134, i.e., in the direction of the arms of the hanger and/or the ends 114 of the indicator. Alternately, the flange may extend radially outward from post 134 in all directions. Alternately, the recess 152 may be formed in the post 134 without flange 150, and may be in that instance stepwise, chamfer or radius, and lateral only or radially in all directions about post 134.

Resilient retaining tab 116 may be considered 'cut from' end wall 114, separated from the indictor 110 by slots 118, and is attached to the indicator 110 at a base 116*a*. Distancing the base 116*a* from the recess 152, as by slots 118, make the resilient retaining tab 116 more flexible. The degree of flexibility of retaining tab 116 can be easily manipulated by adjustment of material, thickness, and/or dimensions of the tab 116.

Referring again to FIG. 3, this perspective view of the lower neck portion 130 further illustrates a notch 154 in the post 134 at a lower portion thereof, adjacent the hanger body 140. Notch 154 includes a horizontal surface 156 at an upper portion of the notch 154, the surface operative to interface with a projection inserted into the notch 154. The projection may be provided on an indicator, for example, as disclosed in U.S. Provisional Patent Application Ser. No. 60/661,588 filed 14 Mar. 2005 by the present inventor, and commonly assigned with the present application, the complete disclosure of which is hereby incorporated by its reference for all purposes.

Therefore, the indicator 110 is releasably secured to the hanger 120, preferably in a child-resistant manner as defined by most industry standards, e.g., those promulgated by Bureau Veritas Consumer Product Services, Inc.

Figure 4:
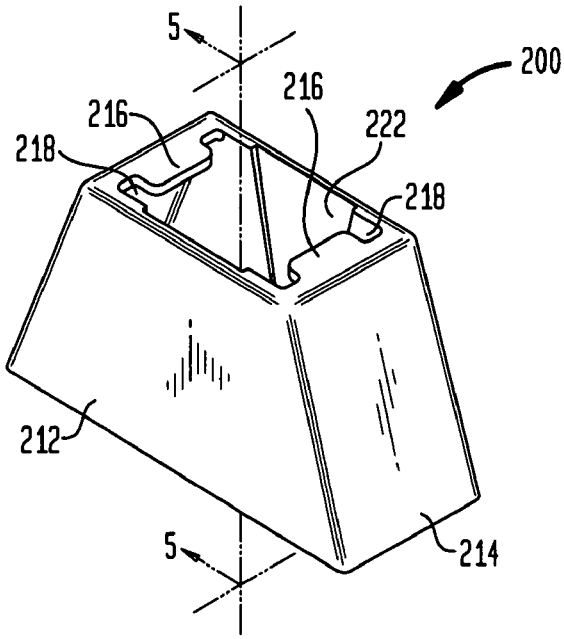
FIG. 4 illustrates a perspective view of a sizing indicator according to a second embodiment of the present invention.

Referring now to FIG. 4, illustrated in perspective view is a sizing indicator, generally 200, according to a second embodiment of the present invention. A detailed description of features the second embodiment has in common with the first, or that are otherwise readily apparent will be dispensed with. In this second embodiment of the indicator 200, resilient tab 216 extends horizontally from an end wall 214, with corresponding slots 218.

Figure 5:
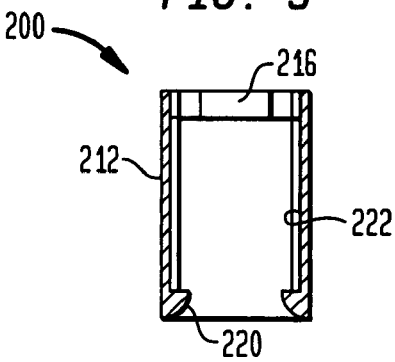
FIG. 5 illustrates a cross sectional view of an indicator taken along line 5-5 of FIG. 4.

Referring now to FIG. 5, illustrated is a cross sectional view of the indicator 200 taken along line 5-5 of FIG. 4. An inward projection 220 extends from the inner surface of side wall 212. In use, inward projections 212 are located within notch 154 of post 134, to further secure the indicator 200. Recess 222 extends from an upper facing horizontal surface of the inward projection 220, and formed by a portion of the mold used in the process of fabricating indicator 200 from an injection molded plastic material. A typical injection molded plastic, for both the indicators 110, 200, or the hanger 140, may be one or more of polystyrene, SAN, ABS, PPO, nylon, polypropylene (PP), polyethylene, PET, polycarbonates (PC), acrylics, K-resin, and polyvinyl chloride (PVC) among others.

The present invention has been described herein with respect to certain exemplary or preferred embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

The invention claimed is:

1. In combination, a hanger and an indicator for displaying information, the combination comprising:

a hanger having a body and a wire hook received and retained in a post extending upward from the body, the intersection of the post and the body defining a lower neck region of the hanger, the post having a flange projecting from the post at a position distanced upward from the body of the hanger, the flange having an undersurface extending away from the post;

an indicator positioned at the lower neck region, substantially surrounding the post, and below the flange, the indicator having a trapezoidal profile defined by a pair of opposing side walls connected by a pair of opposing end walls, the indicator having an opening in each of a top side and a bottom side, a pair of displaceable resilient tabs positioned opposite each other, attached to either the side walls or the end walls, wherein the tabs are provided with a finger-like shape terminating in a free upper end residing under the undersurface of the flange, wherein each of the tabs is further defined by first and second slots, the first and second slots bounding the lateral sides of the tabs, wherein the tabs are configured to provide indicator-retaining interference with the undersurface of the flange, in order to retain the indicator in the lower neck region, the tabs, in cooperation with the slots, further configured to exhibit a flexing action that enlarges the top opening of the indicator to allow the indicator to pass over the flange.

2. The combination hanger and indicator according to claim 1, the hanger further comprising a lip in the undersurface of the flange, the lip sized and positioned to receive a free end of the resilient tab and thereby limit the vertical and lateral movement of the indicator.

3. The combination hanger and indicator according to claim 2, wherein the lip is stepped.

4. The combination hanger and indicator according to claim 1, wherein the resilient tabs are attached to the indicator at the end walls thereof.

5. The combination hanger and indicator according to claim 1, wherein the indicator further comprises a projection extending inwardly from at least one side wall.

6. The combination hanger and indicator according to claim 5, wherein the projection comprises a generally horizontal surface.

7. The combination of claim 1 wherein fee upper ends of the tabs is substantially at a top height of the indicator.

8. The combination of claim 1 wherein the tabs are located on the end walls and are not joined to adjacent sidewalls, thereby providing independent flexibility to each of four walls at an upper portion of the indicator.

9. The combination of claim 1 wherein the free upper ends of the tabs extend at an acute angle relative to the flange.

10. The combination of claim 1 wherein the free upper ends of the tabs extend at an acute angle relative to the hanger post.

11. An indicator for displaying information in association with a garment hanger, the indicator sized, dimensioned, and configured for positioning at a hanger lower neck region, substantially surrounding a post on a hanger that receives and retains a wire hook, the indicator comprising:

a trapezoidal profile defined by a pair of opposing side walls connected by a pair of opposing end walls, the indicator having a top opening substantially defined by a horizontal top plane and a bottom opening substantially defined by a horizontal bottom plane, a pair of displaceable resilient tabs positioned opposite each other, attached to either the side walls or the end walls, wherein the tabs are provided with a finger-like shape terminating in a free upper end substantially at a top height of the indicator, wherein each of the tabs is further defined by first and second slots, the first and second slots bounding the lateral sides of the tabs, wherein the tabs are configured to provide indicator-retaining interference with structure incorporated into the hanger lower neck region, in order to retain the indicator in the lower neck region, while the tabs, in cooperation with the slots, are further configured to exhibit a flexing action that enlarges the top opening of the indicator to allow the indicator to pass over the lower neck region, and wherein the free upper ends of the tabs extend at an acute angle relative to the horizontal top plane of the indicator.

12. The indicator according to claim 11, wherein the pair of displaceable resilient tabs are attached to the end walls thereof.

13. The indicator according to claim 11, wherein the indicator further comprises a projection extending inwardly from at least one side wall.

14. The indicator according to claim 13, wherein the projection comprises a generally horizontal surface.

15. The indicator according to claim 13, wherein the pair of displaceable resilient tabs are attached to the end walls.

16. The indicator of claim 11 wherein the tabs are located on the end walls and are not joined to adjacent sidewalls, thereby providing independent flexibility to each of four walls at an upper portion of the indicator.

17. The indicator of claim 11 wherein the free upper ends of the tabs extend at an acute angle relative to a hanger post that is substantially surrounded by the indicator.

18. The indicator of claim 11 wherein the free upper ends of the tabs extend at an acute angle relative to an undersurface of a flange distanced upward from a hanger body, the undersurface extending away from the post, the indicator substantially surrounding the post.

* * * * *